US007986296B2

(12) United States Patent
Cheng

(10) Patent No.: US 7,986,296 B2
(45) Date of Patent: Jul. 26, 2011

(54) LIQUID CRYSTAL DISPLAY AND ITS DRIVING METHOD

(75) Inventor: Kuo-Hsing Cheng, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 520 days.

(21) Appl. No.: 10/852,008

(22) Filed: May 24, 2004

(65) Prior Publication Data

US 2005/0259067 A1 Nov. 24, 2005

(51) Int. Cl.
*G09G 3/36* (2006.01)

(52) U.S. Cl. ..... 345/103; 345/88; 345/96

(58) Field of Classification Search ..... 345/85–104, 345/58, 690–698; 349/139
See application file for complete search history.

(56) References Cited

U.S. PATENT DOCUMENTS

| | | | | |
|---|---|---|---|---|
| 5,058,994 | A * | 10/1991 | Mihara et al. | 345/97 |
| 5,844,534 | A * | 12/1998 | Okumura et al. | 345/90 |
| 6,320,566 | B1 | 11/2001 | Go | |
| 6,342,876 | B1 * | 1/2002 | Kim | 345/87 |
| 6,496,172 | B1 * | 12/2002 | Hirakata | 345/96 |
| 6,504,523 | B1 * | 1/2003 | Sugawara et al. | 345/98 |
| 6,583,778 | B1 * | 6/2003 | Nishimura et al. | 345/96 |
| 6,590,555 | B2 | 7/2003 | Su et al. | |
| 6,646,628 | B2 | 11/2003 | Shirochi et al. | |
| 6,674,421 | B2 | 1/2004 | Mori et al. | |
| 6,683,592 | B1 * | 1/2004 | Murade | 345/87 |
| 6,717,563 | B2 | 4/2004 | Kim | |
| 6,842,161 | B2 * | 1/2005 | Song et al. | 345/87 |
| 6,982,692 | B2 * | 1/2006 | Kim | 345/96 |
| 7,064,735 | B2 * | 6/2006 | Murade | 345/87 |
| 7,180,488 | B2 * | 2/2007 | Hirakata | 345/87 |
| 7,365,722 | B2 * | 4/2008 | Lee | 345/88 |
| 2001/0015716 | A1 * | 8/2001 | Kim | 345/96 |
| 2001/0033264 | A1 * | 10/2001 | Ishii | 345/92 |
| 2003/0043105 | A1 * | 3/2003 | Hirakata | 345/96 |
| 2004/0032386 | A1 * | 2/2004 | Pai | 345/96 |
| 2004/0178979 | A1 * | 9/2004 | Watanabe et al. | 345/96 |
| 2005/0168425 | A1 * | 8/2005 | Takada et al. | 345/94 |

(Continued)

FOREIGN PATENT DOCUMENTS

JP 4276715 10/1992

(Continued)

OTHER PUBLICATIONS

English Translation of Notification of Reasons for Refusal, Issued by the Japanese Patent Office on Feb. 27, 2008 for corresponding patent application No. JP2005-148884.

(Continued)

*Primary Examiner* — Alexander Eisen
*Assistant Examiner* — Cory A Almeida
(74) *Attorney, Agent, or Firm* — Duane Morris LLP

(57) ABSTRACT

A thin-film-transistor liquid crystal display comprises a display unit which contains a plurality of scanning lines, a plurality of data lines arranged to cross the plurality of scanning lines and defining a plurality of pixels, and a data driving circuit providing pixel data signals to the plurality of data lines. The pixels of each scanning line are divided into groups of N successive pixels, where N is an integer greater than 1. A polarity of the respective pixel data signals for the data lines within each group is the same as each other. The polarity of the respective pixel data signals for each successive group along at least one of the scanning lines alternates between a first polarity and a second polarity.

11 Claims, 16 Drawing Sheets

U.S. PATENT DOCUMENTS

| | | | | |
|---|---|---|---|---|
| 2006/0028426 | A1 * | 2/2006 | Hiratsuka | 345/103 |

FOREIGN PATENT DOCUMENTS

| | | | |
|---|---|---|---|
| JP | 2637515 | | 8/1997 |
| JP | 2002049020 | A | 2/2002 |
| JP | 3291396 | | 6/2002 |
| JP | 2003177424 | A | 6/2003 |
| JP | 2003-216124 | * | 7/2003 |
| JP | 3476885 | | 12/2003 |
| JP | 2004-271719 | | 9/2004 |

OTHER PUBLICATIONS

Office Action of corresponding Japanese patent application JP2005-148884 mailed on Jun. 24, 2008.

* cited by examiner

| | | | |
|---|---|---|---|
| + | − | + | − |
| + | − | + | − |
| + | − | + | − |
| + | − | + | − |
| + | − | + | − |
| + | − | + | − |

FIG. 3A (PRIOR ART)

| | | | |
|---|---|---|---|
| − | + | − | + |
| − | + | − | + |
| − | + | − | + |
| − | + | − | + |
| − | + | − | + |
| − | + | − | + |

FIG. 3B (PRIOR ART)

| | | | | | |
|---|---|---|---|---|---|
| + | − | + | − | + | − |
| + | − | + | − | + | − |
| + | − | + | − | + | − |
| + | − | + | − | + | − |
| + | − | + | − | + | − |
| + | − | + | − | + | − |

FIG. 4A (PRIOR ART)

| | | | | | |
|---|---|---|---|---|---|
| − | + | − | + | − | + |
| − | + | − | + | − | + |
| − | + | − | + | − | + |
| − | + | − | + | − | + |
| − | + | − | + | − | + |
| − | + | − | + | − | + |

FIG. 4B (PRIOR ART)

| | | | |
|---|---|---|---|
| + | − | + | − |
| − | + | − | + |
| + | − | + | − |
| − | + | − | + |
| + | − | + | − |
| − | + | − | + |

FIG. 5A (PRIOR ART)

| | | | |
|---|---|---|---|
| − | + | − | + |
| + | − | + | − |
| − | + | − | + |
| + | − | + | − |
| − | + | − | + |
| + | − | + | − |

FIG. 5B (PRIOR ART)

| | D1 | D2 | D3 | D4 | D5 | D6 | D7 | D8 | D9 | D10 | D11 | D12 |
|---|---|---|---|---|---|---|---|---|---|---|---|---|
| R1 | + | + | + | − | − | − | + | + | + | − | − | − |
| G1 | − | − | − | + | + | + | − | − | − | + | + | + |
| B1 | + | + | + | − | − | − | + | + | + | − | − | − |
| R2 | − | − | − | + | + | + | − | − | − | + | + | + |
| G2 | + | + | + | − | − | − | + | + | + | − | − | − |
| B2 | − | − | − | + | + | + | − | − | − | + | + | + |
| R3 | + | + | + | − | − | − | + | + | + | − | − | − |
| G3 | − | − | − | + | + | + | − | − | − | + | + | + |
| B3 | + | + | + | − | − | − | + | + | + | − | − | − |
| R4 | − | − | − | + | + | + | − | − | − | + | + | + |
| G4 | + | + | + | − | − | − | + | + | + | − | − | − |
| B4 | − | − | − | + | + | + | − | − | − | + | + | + |

FIG. 8A

| | D1 | D2 | D3 | D4 | D5 | D6 | D7 | D8 | D9 | D10 | D11 | D12 |
|---|---|---|---|---|---|---|---|---|---|---|---|---|
| R1 | − | − | − | + | + | + | − | − | − | + | + | + |
| G1 | + | + | + | − | − | − | + | + | + | − | − | − |
| B1 | − | − | − | + | + | + | − | − | − | + | + | + |
| R2 | + | + | + | − | − | − | + | + | + | − | − | − |
| G2 | + | + | + | − | − | − | + | + | + | − | − | − |
| B2 | + | + | + | − | − | − | + | + | + | − | − | − |
| R3 | − | − | − | + | + | + | − | − | − | + | + | + |
| G3 | − | − | − | + | + | + | − | − | − | + | + | + |
| B3 | − | − | − | + | + | + | − | − | − | + | + | + |
| R4 | + | + | + | − | − | − | + | + | + | − | − | − |
| G4 | + | + | + | − | − | − | + | + | + | − | − | − |
| B4 | − | − | − | + | + | + | − | − | − | + | + | + |

FIG. 8B

| | | | | | | |
|---|---|---|---|---|---|---|
| R1 | + | + | + | + | + | + |
| G1 | + | + | + | + | + | + |
| B1 | + | + | + | + | + | + |
| R2 | + | + | + | + | + | + |
| G2 | + | + | + | + | + | + |
| B2 | + | + | + | + | + | + |
| R3 | − | − | − | − | − | − |
| G3 | − | − | − | − | − | − |
| B3 | − | − | − | − | − | − |
| R4 | − | − | − | − | − | − |
| G4 | − | − | − | − | − | − |
| B4 | − | − | − | − | − | − |

FIG. 9A

| R1 | G1 | B1 | R2 | G2 | B2 | R3 | G3 | B3 | R4 | G4 | B4 |
|---|---|---|---|---|---|---|---|---|---|---|---|
| − | − | − | − | − | − | + | + | + | + | + | + |
| + | + | + | + | + | + | − | − | − | − | − | − |
| − | − | − | − | − | − | + | + | + | + | + | + |
| + | + | + | + | + | + | − | − | − | − | − | − |
| − | − | − | − | − | − | + | + | + | + | + | + |
| + | + | + | + | + | + | − | − | − | − | − | − |

FIG. 9B

| | | | | | |
|---|---|---|---|---|---|
| I | + | I | + | I | + |
| I | + | I | + | I | + |
| I | + | I | + | I | + |
| I | + | I | + | I | + |
| I | + | I | + | I | + |
| I | + | I | + | I | + |
| I | + | I | + | I | + |
| I | + | I | + | I | + |
| I | + | I | + | I | + |
| + | I | + | I | + | I |
| + | I | + | I | + | I |
| + | I | + | I | + | I |
| + | I | + | I | + | I |
| + | I | + | I | + | I |
| + | I | + | I | + | I |
| + | I | + | I | + | I |
| + | I | + | I | + | I |
| + | I | + | I | + | I |

FIG. 10

| | | | | | |
|---|---|---|---|---|---|
| I | + | I | + | I | + |
| I | + | I | + | I | + |
| + | I | + | I | + | I |
| + | I | + | I | + | I |
| I | + | I | + | I | + |
| I | + | I | + | I | + |
| + | I | + | I | + | I |
| + | I | + | I | + | I |
| I | + | I | + | I | + |
| I | + | I | + | I | + |
| + | I | + | I | + | I |
| + | I | + | I | + | I |

FIG. 11

LIQUID CRYSTAL DISPLAY AND ITS DRIVING METHOD

FIELD OF THE INVENTION

The present invention relates to a liquid crystal display (LCD), and more particularly to a driving method for an LCD.

BACKGROUND

In general, a liquid crystal display (LCD) controls a light transmittance of each liquid crystal cell according to a video signal to display a picture. In other words, a liquid crystal displays contains a plurality of picture elements, or pixels, formed by liquid crystal cells that change the polarization direction of light in response to an electrical voltage of the video signal. By controlling a voltage applied to a liquid crystal cell, the amount of light coming out of the LCD changes. Among various driving methods, active matrix liquid crystal displays, which have a respective switching element such as a thin film transistor for each of the pixels so as to control a voltage to be applied to the liquid crystal, are superior in display quality. Thus, active matrix LCDs have been intensively developed and have come to be widely used as monitors in personal computers.

FIG. 1 shows a perspective view of a conventional LCD which comprises an upper panel 110, a lower panel 120, and liquid crystal materials 130 inserted therebetween. The upper panel 110 contains an upper substrate 112, an upper polarization plate 114, a color filter 116, and a common electrode 118. The lower panel includes a lower substrate 122 and a lower polarization plate 124. The layout of the lower substrate 122 includes a plurality of scanning lines 140, a plurality of data lines 142 which perpendicularly cross the scanning lines, a plurality of thin film transistors 144 (TFTs), and a plurality of pixel electrodes 146.

In FIG. 2, a data driving circuit 210 receives video data signals 212 and polarity control signals 214 and applies pixel data signals to data lines D1-DN. The pixel data signals represent the gray level of red, green, and blue pixels. A scan driving circuit 220 receives scanning control signals 222 and is electrically connected to scanning lines S1-SN. When a voltage is applied to a scanning line, all the TFTs connected to the scanning line are turned on. As a result, the pixel data signals are sent to the pixel electrodes for that scanning line through the TFTs and a voltage is applied to pixel electrodes. On the other hand, a constant voltage Vcom is applied to the common electrode. The difference of voltages between the common electrode Vcom and the pixel electrode creates an electric field resulting in the rotation of liquid crystal molecules and a specific gray level.

Typically, a pixel data signal has either positive polarity or negative polarity depending on whether the voltage of the pixel data signal is higher or lower than a common electrode voltage Vcom. A pixel data signal has positive polarity when its voltage level is higher than the common electrode voltage Vcom. Also, a pixel data signal has negative polarity when its voltage is lower than the common electrode voltage Vcom. The light transmission from the liquid crystal materials (and, therefore, the gray level presented by a pixel,) is related to the difference between the voltages of the pixel data signal and the common electrode voltage Vcom, regardless of the polarity of the pixel data signal. However, a pixel data signal having positive polarity causes liquid crystal molecules to turn to a direction opposite to that caused by a pixel data signal having negative polarity. In order to prolong the lifetime of an LCD, some conventional driving methods such as dot inversion, line inversion, and column inversion are designed to change the polarity of pixel data signals.

FIGS. 3A and 3B are tables showing the polarity of pixel data signals driven by the line inversion method, in which the polarity of pixel data signals is reversed at every scanning line (row). In the column inversion method as shown in FIGS. 4A and 4B, the polarity of pixel data signals is reversed at every data line (column). In the dot inversion as shown in FIGS. 5A and 5B, the polarity is reversed at every row and column. Also, FIGS. 3A, 4A, and 5A represent the polarity status at a specific time frame and FIGS. 3B, 4B, and 5B represent the polarity status at the next time frame. Thus, for any given pixel, the polarity changes each time the pixel is scanned.

At a specific time frame, different polarities of pixel data signals for two adjacent pixels may cause light leakage because of the edge electric field effect resulting from either one of the adjacent pixel electrodes. FIG. 6A shows two adjacent pixels with pixel electrodes 632 and 634, and the data line 625. FIG. 6B is a schematic drawing of a cross-sectional view taken along the section line 6B-6B of FIG. 6A. A TFT layer 620 with a data line 625 is disposed on a substrate 610. The pixel electrodes 632 and 634 are disposed on the TFT layer 620. The liquid crystal material 630 is filled underneath a common electrode 640. A color filter 650 is disposed on the common electrode 640. An edge electric field is generated to effect the rotation of liquid crystal molecules because the polarity of pixel electrode 632 is different from that of pixel electrode 634. As a result, light leakage 660 may occur if the width of data line 625 is not large enough to block the light. If wider data lines are used to prevent light leakage, the aperture ratio of the LCD is sacrificed.

The dot inversion driving method has the serious disadvantage of lower aperture ratio or light leakage. The line inversion driving method has a high system load, because the total voltage level of pixel electrodes connected to a scanning line is high. The column inversion method has the same disadvantage as the dot inversion driving method. Thus, a driving method to resolve these difficulties is desired.

SUMMARY OF THE INVENTION

A thin-film-transistor liquid crystal display comprises a display unit which contains a plurality of scanning lines, a plurality of data lines arranged to cross the plurality of scanning lines and defining a plurality of pixels, and a data driving circuit providing data signals to the plurality of data lines. The pixels of each scanning line are divided into groups of N successive pixels, where N is an integer greater than 1. A polarity of the respective pixel data signals for the data lines within each group is the same as each other. The polarity of the respective pixel data signals for each successive group along at least one of the scanning lines alternates between a first polarity and a second polarity.

BRIEF DESCRIPTION OF THE DRAWINGS

A more complete understanding of the present invention can be obtained by reference to the detailed description of embodiments in conjunction with the accompanying drawings, in which:

FIGS. 3A and 3B are tables showing the polarity of pixel data signals driven by a line inversion method;

FIGS. 4A and 4B are tables showing the polarity of pixel data signals driven by a column inversion method;

FIGS. 5A and 5B are tables showing the polarity of pixel data signals driven by a dot inversion method;

FIGS. 8A and 8B are tables showing the polarity of pixel data signals driven by an inversion method with groups of three pixels;

FIGS. 9A and 9B are tables showing the polarity of pixel data signals driven by an inversion method with groups of six pixels;

FIGS. 10 is a table showing the polarity of pixel data signals driven by an inversion method with groups of nine pixels;

FIG. 11 is a table showing the polarity of pixel data signals driven by an inversion method with groups of two pixels;

DETAILED DESCRIPTION

Figure 1:
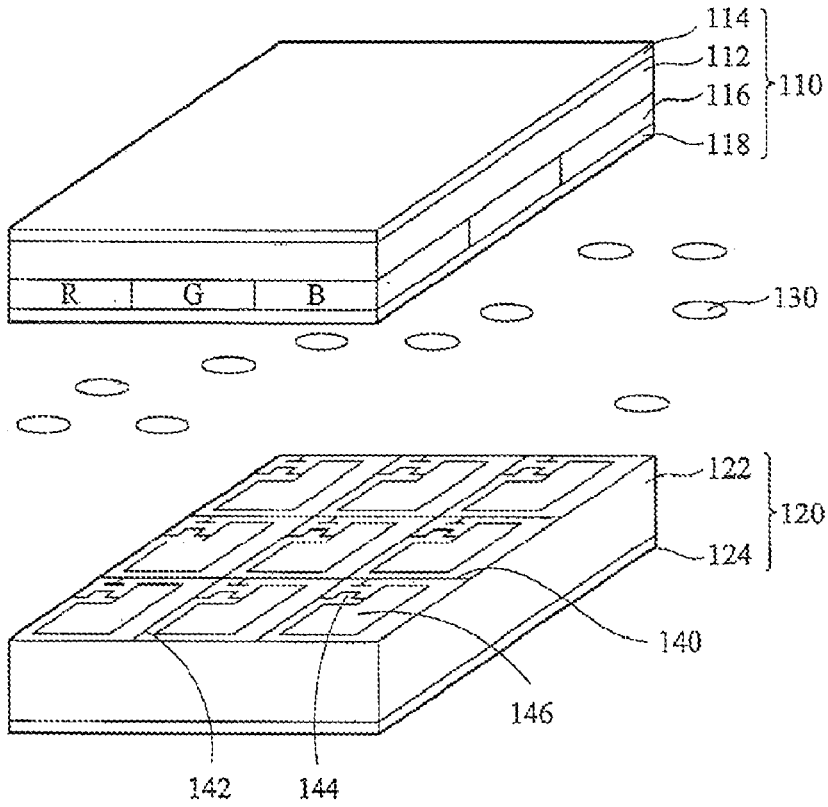
FIG.1 (Prior Art)
FIG. 1 illustrates a perspective view of a conventional liquid crystal display.
Figure 2:
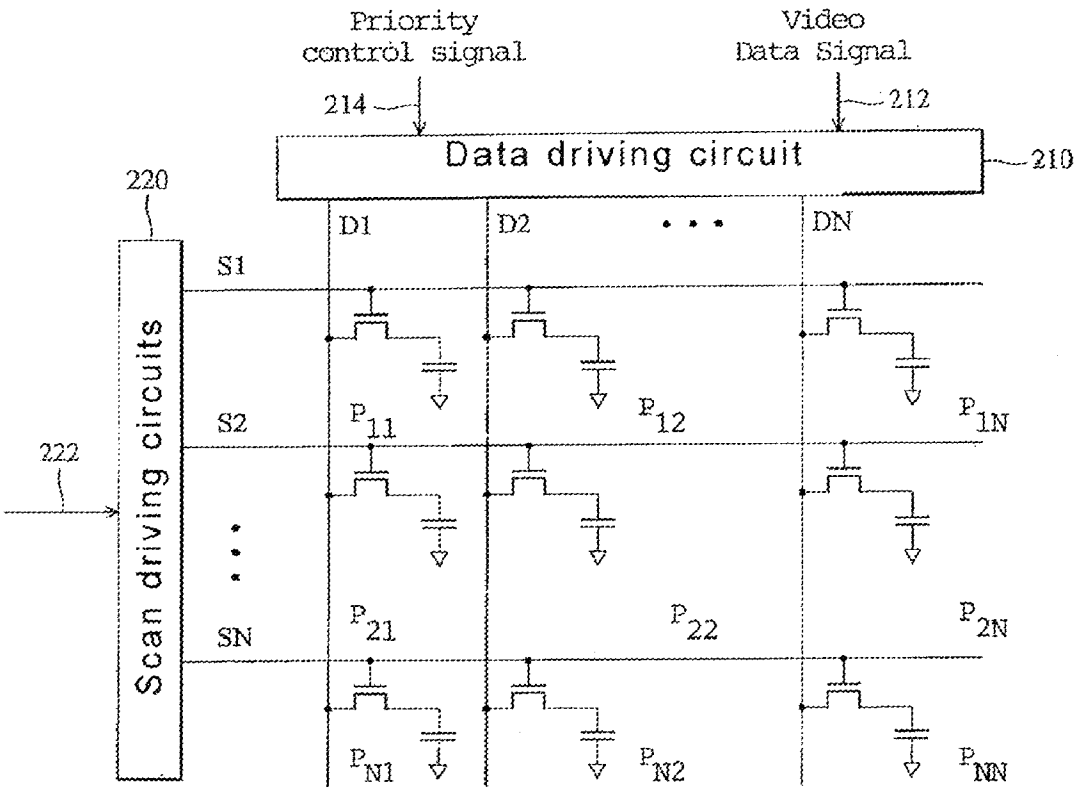
FIG. 2 (Prior Art)
FIG. 2 is a schematic diagram showing the structure of a lower panel in FIG. 1.
Figure 6A:
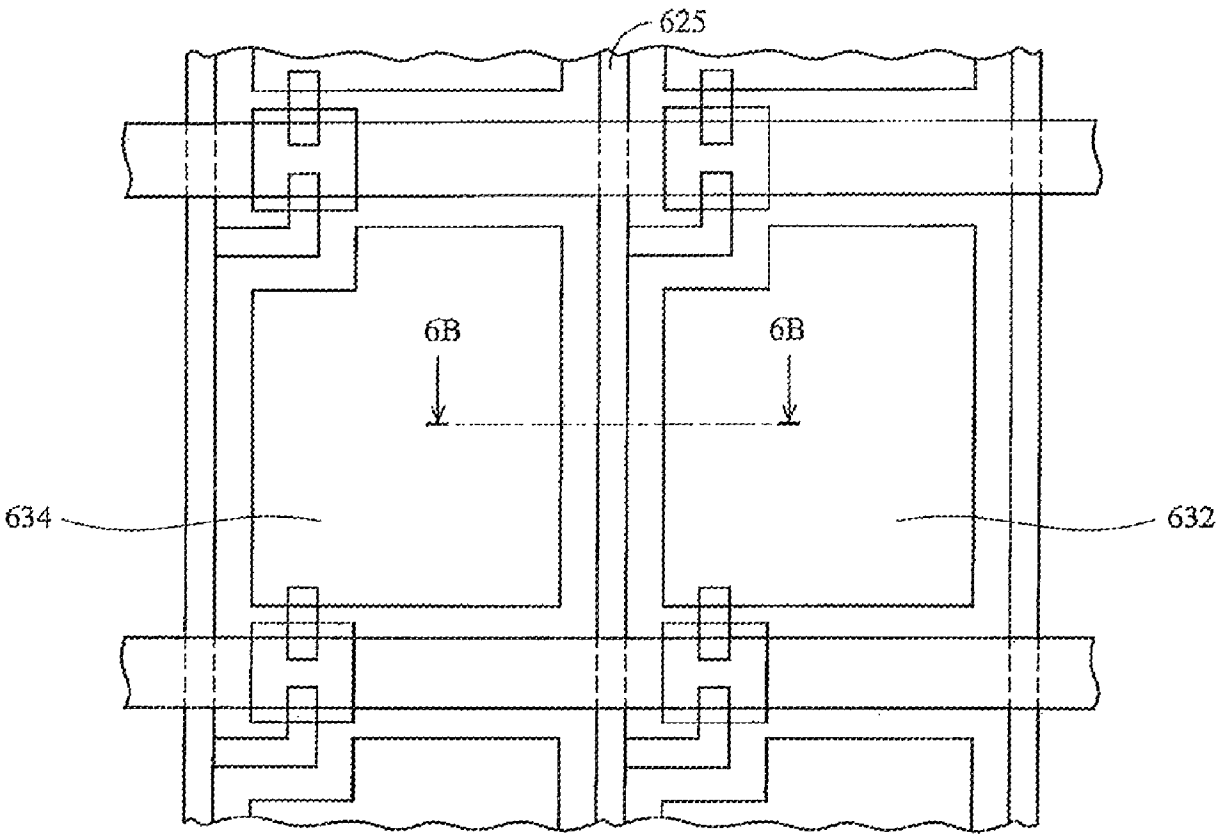
FIG. 6A (Prior Art)
FIG. 6A is a schematic diagram showing two adjacent pixels on a scanning line.
Figure 6B:
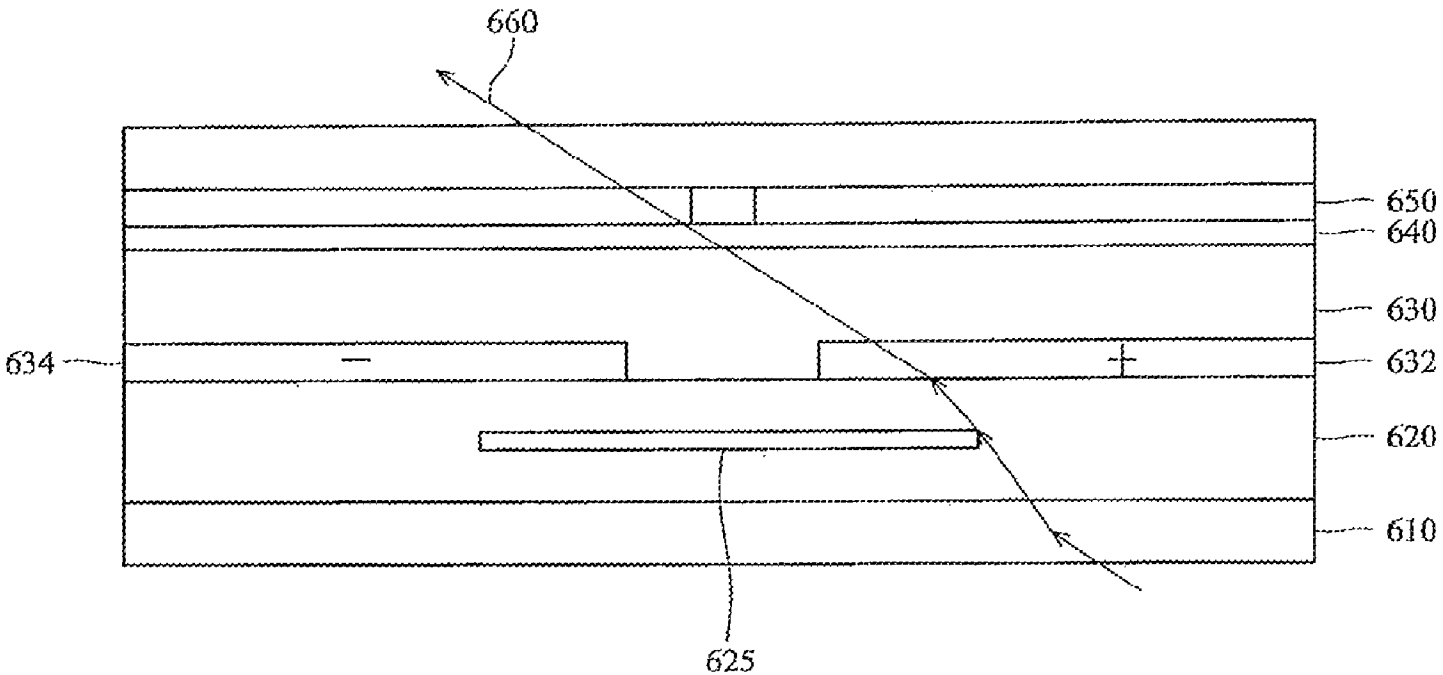
FIG. 6B (Prior Art)
FIG. 6B illustrates a cross-sectional view along the line 6B-6B shown in FIG. 6A.
Figure 7:
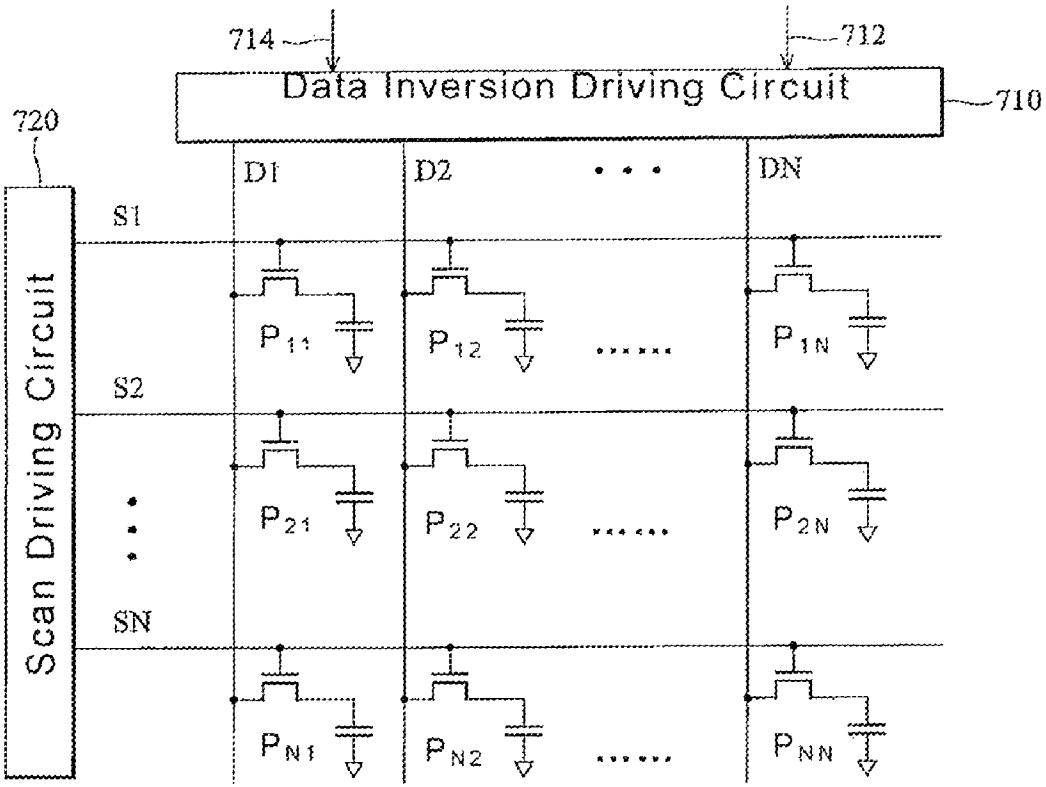
FIG. 7 is a schematic diagram showing the structure of liquid crystal display using an inventive driving method.

As shown in FIG. 7, an exemplary embodiment of an LCD comprises a plurality of scanning lines S1-SN, a plurality of data lines D1-DN arranged to cross the plurality of scanning lines S1-SN and to define a plurality of pixels, a data inversion driving circuit 710, and a scan driving circuit 720. The data inversion driving circuit 710 receives video data signal 712 and priority control signal 714 to generate pixel data signals transmitted to the plurality of data lines D1-DN.

The video data signal 712 indicates the gray level of red, green, and blue pixels. The data inversion driving circuit 710 employs priority control signal 714 to convert the video data signal 712 into pixel data signal with a desired inversion driving pattern. A pixel data signal has either positive polarity or negative polarity depending on whether the voltage of the pixel data signal is higher or lower than a common electrode voltage Vcom. A pixel data signal has positive polarity when its voltage level is higher than the common electrode voltage Vcom. Likewise, a pixel data signal has negative polarity when its voltage is lower than the common electrode voltage Vcom. The light transmission from liquid crystal materials (the gray level presented by a pixel) is related to the difference between the voltage of the pixel data signal and the common electrode voltage Vcom, regardless of the polarity of the pixel data signal. However, a pixel data signal having the positive polarity causes liquid crystal molecules to turn to a direction opposite to that caused by a pixel data signal having the negative polarity.

FIG. 8A shows an exemplary embodiment of an inversion driving pattern in a specific time frame. The pixels of each scanning line are divided into groups of three (3) successive pixels, which are respectively red, green, and blue color pixels. The polarities of the respective pixel data signals for the data lines within each group are the same as each other. For example, the polarity of pixel data signals for pixels R1, G1, B1 in the first scanning line is the same, i.e. all are positive. The polarity of the respective pixel data signals for each successive group along the scanning lines alternates between a first polarity and a second polarity. For example, the polarities of pixel data signals for pixels R2, G2, B2 in the first scanning line are the same as each other, but the polarity of R2, G2, B2 is negative which is different from that of the adjacent pixel group (R1, G1, B1). The polarities of pixel data signals for pixels R3, G3, B3 in the first scanning line are the same as each other, but the polarity of R3, G3, B3 alternates back to the positive.

In one embodiment, the inversion driving pattern can be generated by assigning a polarity of the respective pixel data signals for the data lines within each group to be the same as each other and assigning the polarity of the respective pixel data signals for each successive group along the same scanning line to alternate between a first polarity and a second polarity. The data inversion driving circuit 710 then provides pixel data signals to the data lines.

In a given time frame, the polarity of the respective pixel data signals for each successive group in successive scanning lines and within the same data lines alternates between the first polarity and the second polarity. For example, the polarity of pixel data signals for the pixel group (R1, G1, B1) in the first scanning line is positive. The polarity of pixel data signal for the successive pixel group (R1, G1, B1) in the second scanning line is negative which is different from that of the first scanning line. The polarity of pixel data signal for the next successive pixel group (R1, G1, B1) in the third scanning line alternates back to the positive. In one embodiment, the polarity of the respective pixel data signals for each successive group in successive scanning lines and within the same data lines is assigned by the data inversion driving circuit 710 to alternate between the first polarity and the second polarity.

FIG. 8B shows an exemplary embodiment of a inversion driving pattern in a time frame succeeding that shown in FIG. 8A. The polarity of the respective pixel data signals for each group in successive frames alternates between the first polarity and the second polarity. For example, in FIG. 8A the polarity of pixel data signal for pixel group (R1, G1, B1) in the first scanning line is positive. In the next successive time frame as shown in FIG. 8B, the polarity of pixel data signal for the same pixel group (R1, G1, B1) in the first scanning line is negative, which is different from that in the immediately preceding frame shown in FIG. 8A. In one embodiment, the data inversion driving circuit 710 assigns the polarity of the respective pixel data signals for any given group in successive frames to alternate between the first polarity and the second polarity.

FIG. 9A shows another embodiment of an inversion driving pattern in a specific time frame where the pixels of each scanning line are divided into groups of six (6) successive pixels. Polarity of the respective pixel data signals for pixels within any given pixel group are the same as each other. For example, the polarities of pixel data signal for pixels R1, G1, B1, R2, G2, B2 (the first pixel group) in the first scanning line are the same as each other; all are positive. The polarities of the respective pixel data signals for each successive group along the same scanning line alternate between a first polarity and a second polarity. For example, the polarities of pixel data signal for pixels R3, G3, B3, R4, G4, B4 (the second pixel group) in the first scanning line are the same as each other, but the polarity is negative, which is different from that of the first pixel group (R1, G1, B1, R2, G2, B2).

In any given time frame, the polarity of the respective pixel data signals for each successive group in successive scanning line and within the same data lines alternates between the first polarity and the second polarity. For example, the polarity of pixel data signals for the pixel group (R1, G1, B1, R2, G2, B2) in the first scanning line is positive. The polarity of pixel data signals for the successive pixel group (R1, G1, B1, R2, G2, B2) in the second scanning line is negative which is different from that of the first scanning line. The polarity of pixel data signals for the next successive pixel group (R1, G1, B1, R2, G2, B2) in the third scanning line alternates back to the positive.

FIG. 9B shows an inversion driving pattern in a time frame immediately succeeding that in FIG. 9A. The polarity of the respective pixel data signals for any given group in successive frames alternates between the first polarity and the second polarity. For example, in FIG. 9A the polarity of pixel data signals for pixel group (R1, G1, B1, R2, G2, B2) in the first scanning line is positive. In the next successive time frame as shown in FIG. 9B, the polarity of pixel data signals for the same pixel group (R1, G1, B1, R2, G2, B2) in the same scanning line is negative which is different from that in the previous successive frame shown in FIG. 8A.

As shown in FIG. 10, another embodiment of an inversion driving pattern divides the pixels in a scanning line into groups of nine (9) successive pixels. Similarly, FIG. 11 shows another embodiment which divides the pixels in a scanning line into groups of two (2) successive pixels. Although the pixels in a scanning line can be divided into groups of N successive pixels as long as N is an integer greater than one (1), the number of total pixels in a scanning line does not have to be a multiple of N.

Figure 12:
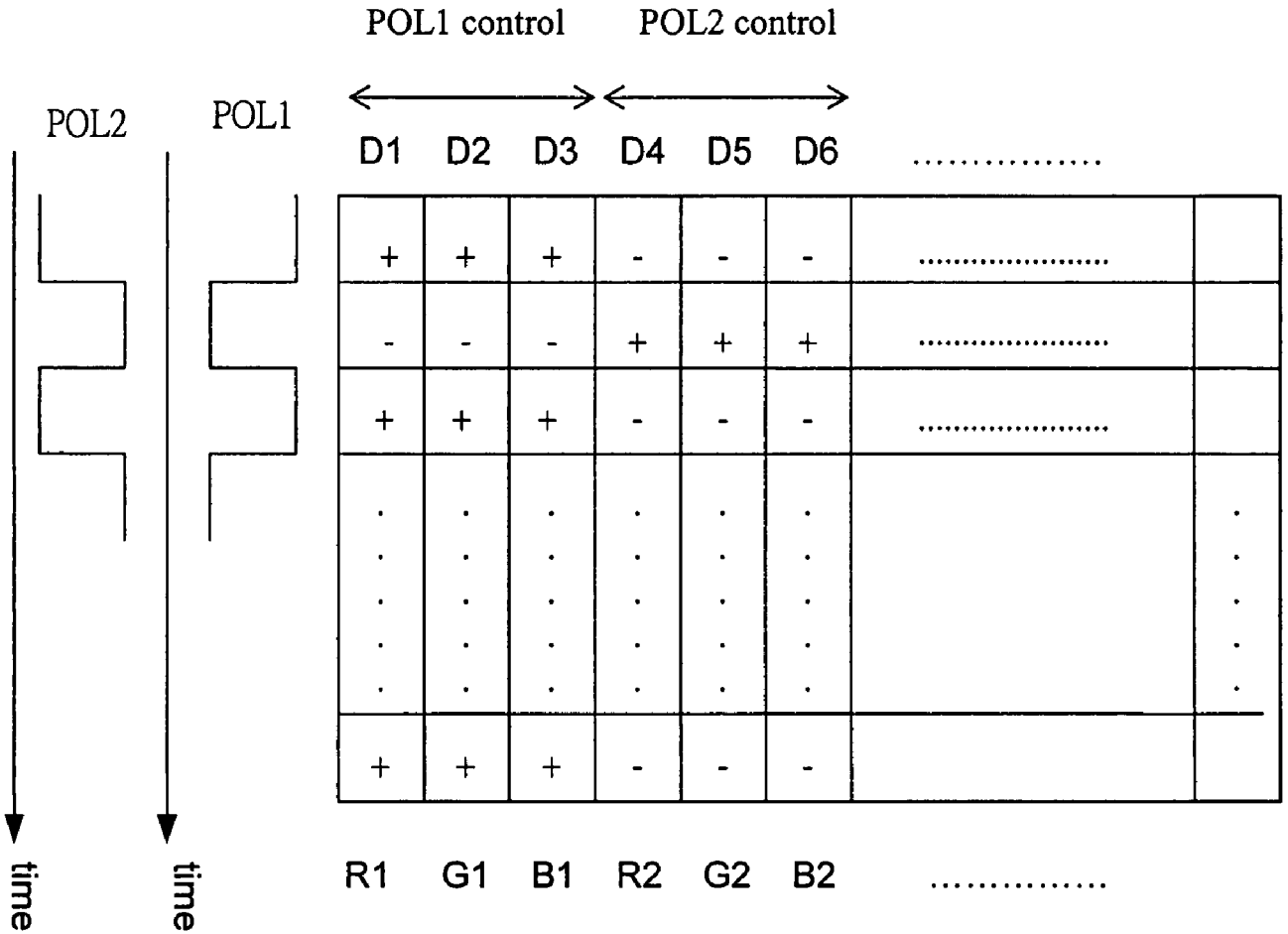
FIG. 12 illustrates an exemplary embodiment of employing priority control signals to generate an inversion driving pattern.

In FIG. 12, an exemplary embodiment employs signals POL1 and POL2 as priority control signal 714 to generate the inversion driving pattern. Skilled artisans will appreciate many other ways to generate an inversion driving pattern.

Figure 13:
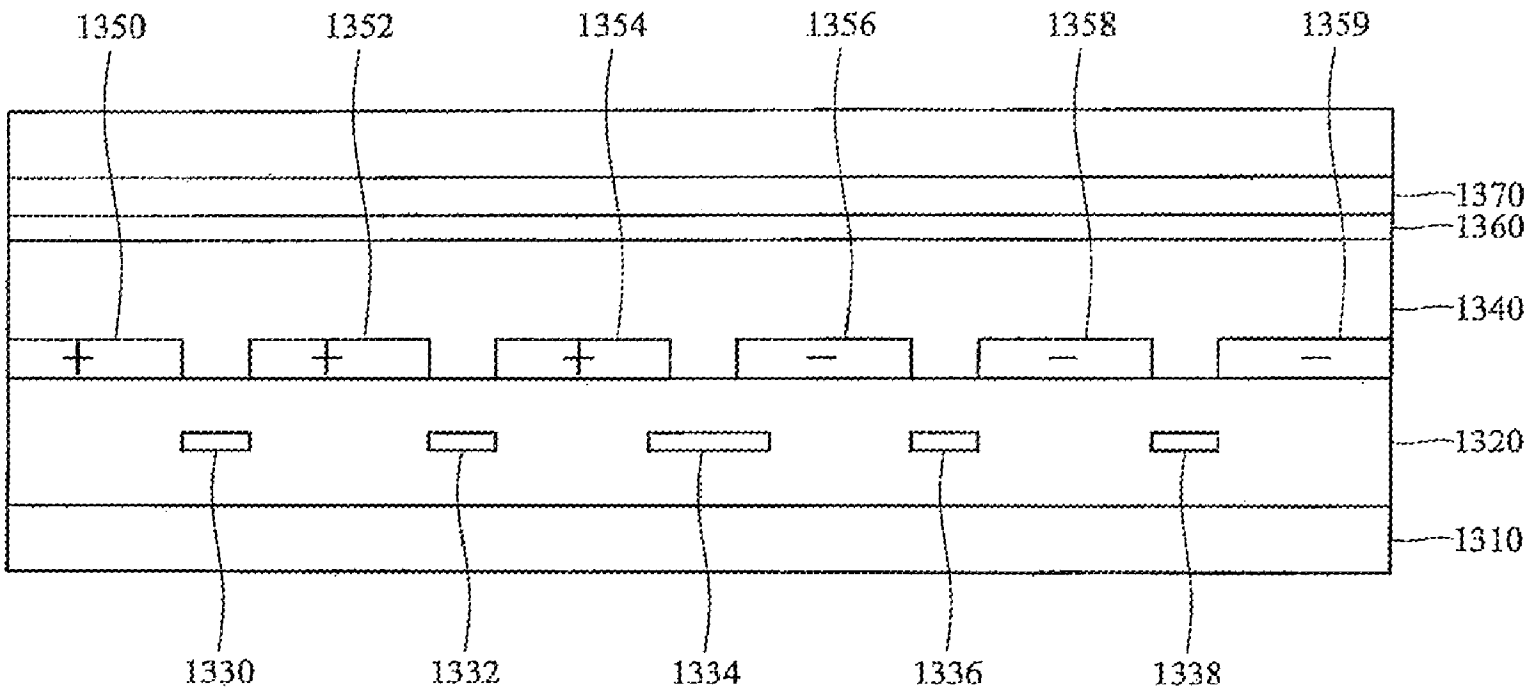
FIG. 13 illustrates an exemplary embodiment of an LCD with a wider data line between two successive pixel groups than data lines within each pixel group.

FIG. 13 shows an exemplary embodiment of an LCD with a data line between two successive pixel groups that is wider than data lines within each pixel group. This embodiment is driven by an inversion driving pattern as shown in FIG. 8A. A TFT layer 1320 with data lines 1330, 1332, 1334, 1336, and 1338 is disposed on a substrate 1310. The pixel electrodes 1350, 1352, 1354, 1356, and 1358 are disposed on the TFT layer 1320. The liquid crystal material 1340 is filled underneath a common electrode 1360. A color filter 1370 is disposed on the common electrode 1360. Because the pixels are divided into groups of three (3) successive pixels, the pixel electrodes 1350, 1352, and 1354 have positive polarity; the pixel electrodes 1356, 1358, and 1360 have negative polarity. Although there is no edge electric field between pixel electrodes 1350 and 1352, or between pixels 1352 and 1354, an edge electric field between pixel electrodes 1354 and 1356 could cause light leakage. As a result, the data line 1334 is wider to eliminate the light leakage.

In the embodiment of FIG. 13, every third data line is wider to accommodate having groups of three pixels as shown in FIGS. 8A and 8B. One of ordinary skill will understand that for any group size N, where N pixels within each group have the same polarity and successive groups alternate in polarity, every Nth data line can be made wider to eliminate light leakage. Thus, by making N greater than one, light leakage can be eliminated without a severe reduction in aperture ratio.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A thin-film-transistor liquid crystal display, comprising:

a display unit containing a plurality of scanning lines, and a plurality of data lines which are arranged in a plane to cross the plurality of scanning lines and defining a plurality of pixels that form a pixel area, all of the pixels of each scanning line being divided into groups of N successive pixels, where N is an integer greater than 1 such that each said pixel is part of one of said groups; and a data driving circuit providing pixel data signals to the plurality of data lines, a polarity of the respective pixel data signals for the data lines within each group being the same as each other, the polarity of the respective pixel data signals for each successive group along at least one of the scanning lines alternating between a first polarity and a second polarity, wherein one of the data lines between two successive groups in the pixel area is wider than each of the data lines within each group in the pixel area.

2. The thin-film-transistor liquid crystal display of claim 1, wherein the polarity of the respective pixel data signals for each successive group within a row or column perpendicular to the scanning lines for a given frame alternates between the first polarity and the second polarity.

3. The thin-film-transistor liquid crystal display of claim 1, wherein the polarity of the respective pixel data signals for each group in successive frames alternates between the first polarity and the second polarity.

4. The thin-film-transistor liquid crystal display of claim 1, wherein N is a multiple of three and each group includes a red pixel, a green pixel and a blue pixel.

5. The thin-film-transistor liquid crystal display of claim 1, wherein N is six.

6. The thin-film-transistor liquid crystal display of claim 1, wherein N is nine.

7. A thin-film-transistor liquid crystal display, comprising:

a display unit containing a plurality of scanning lines, and a plurality of data lines which are arranged in a plane to cross the plurality of scanning lines and defining a plurality of pixels that form a pixel area, all of the pixels of each scanning line being divided into groups of N successive pixels, where N is an integer greater than 1 such that each said pixel is part of one of said groups; and a data driving circuit providing pixel data signals to the plurality of data lines, a polarity of the respective pixel data signals for the data lines within each group being the same as each other, the polarity of the respective pixel data signals for each one of the groups along one of the scanning lines being opposite of the polarity of the pixel data signals for each group adjacent to the one group along the same scanning line, wherein one of the data lines between two successive groups in the pixel area is wider than each of the data lines within each group in the pixel area.

8. A method to drive a thin-film-transistor liquid crystal display comprising a plurality of scanning lines, and a plurality of data lines which are arranged in a plane to cross the plurality of scanning lines and defining a plurality of pixels that form a pixel area, all of the pixels of each scanning line being divided into groups of N successive pixels, where N is an integer greater than 1 such that each said pixel is part of one of said groups, comprising the steps of:

assigning a polarity of the respective pixel data signals for the data lines within each group to be the same as each other;

assigning the polarity of the respective pixel data signals for each successive group along each one of the scanning lines to be alternating between a first polarity and a second polarity;

providing pixel data signals to the data lines; and driving the thin-film-transistor liquid crystal display, wherein one of the data lines between two successive groups in the pixel area is wider than each of the data lines within each group in the pixel area.

9. The method of claim 8, further comprising:

assigning the polarity of the respective pixel data signals for each successive group within a row or column perpendicular to the scanning lines for a given frame to alternate between the first polarity and the second polarity.

10. The method of claim 8, further comprising:

assigning the polarity of the respective pixel data signals for each successive group in successive frames to alternate between the first polarity and the second polarity.

11. The method of claim 8, wherein N is a multiple of three and each group includes a red pixel, a green pixel and a blue pixel.

* * * * *